US005758519A

United States Patent [19]

Joyce et al.

[11] Patent Number: 5,758,519

[45] Date of Patent: Jun. 2, 1998

[54] METHOD AND APPARATUS FOR FORMING COMPOSITE DRAWCORD/ELASTIC WAISTBAND

[75] Inventors: Christopher W. Joyce, Ramseur; Richard T. Grier; Dan W. Tanner, both of Asheboro; Danny Corum, Franklinville, all of N.C.

[73] Assignee: Asheboro Elastics Corp., Asheboro, N.C.

[21] Appl. No.: 897,882

[22] Filed: Jul. 21, 1997

Related U.S. Application Data

[63] Continuation of Ser. No. 607,322, Feb. 26, 1996, abandoned.

[51] Int. Cl.[6] ..... D04B 11/00; A41D 1/14

[52] U.S. Cl. ..... 66/83; 66/1 R; 66/85 R; 66/203; 66/61; 66/170; 66/192; 2/220; 2/221

[58] Field of Search ..... 66/80, 81, 82 R, 66/83, 84 R, 84 A; 2/76, 236, 237, 220, 221, 243.1

[56] References Cited

U.S. PATENT DOCUMENTS

| | | | |
|---|---|---|---|
| Re. 33,586 | 5/1991 | Graff | 2/221 |
| 2,185,844 | 1/1940 | Gastrich et al. | 66/83 |
| 3,523,430 | 8/1970 | Inui | 66/84 |
| 4,477,928 | 10/1984 | Graff | 2/221 |
| 5,040,244 | 8/1991 | Tubbs | 2/237 |
| 5,186,779 | 2/1993 | Tubbs | 156/161 |
| 5,375,266 | 12/1994 | Crisco | 2/243.1 |
| 5,400,729 | 3/1995 | Bryant | 112/121.26 |
| 5,452,591 | 9/1995 | King | 66/83 |

FOREIGN PATENT DOCUMENTS

| | | |
|---|---|---|
| 16195 | 8/1893 | United Kingdom . |

*Primary Examiner*—John J. Calvert

*Attorney, Agent, or Firm*—Rhodes, Coats & Bennett, L.L.P.

[57] ABSTRACT

A knitting machine and method for forming a composite band including an elongate knitted band and a drawcord secured to a front face of the knitted band by a covering yarn overlying the drawcord and stitched to the elongate band. The knitting machine includes a frame. A first knitting station is provided supported by the frame for forming the elongate knitted band. A second knitting station is provided supported by the frame and downstream of the first knitting station for receiving the knitted band after it exits the first knitting station. The second knitting station is operative to stitch the covering yarn to the knitted band from opposite sides of and across the drawcord to form a channel area defined between the covering yarn and the front face of the knitted band, the drawcord disposed in the channel area.

25 Claims, 6 Drawing Sheets

METHOD AND APPARATUS FOR FORMING COMPOSITE DRAWCORD/ELASTIC WAISTBAND

This application is a continuation of application Ser. No. 08/607,322, filed Feb. 26, 1996, now abandoned.

FIELD OF THE INVENTION

The present invention relates generally to elastic bands for use in the construction of garments, and more particularly, to a method and apparatus for conveniently and cost effectively forming a composite elastic band and drawcord.

BACKGROUND OF THE INVENTION

Many types of clothing, such as athletic shorts and sweatpants, use an elastic waistband in combination with a drawstring so that the garment can be worn by persons of different size. In most garments of this type, the elastic waistband and drawstring are incorporated into the garment in separate steps. First, the waistband is stretched and sewn to the garment. The second step involves forming a channel for the drawstring and then inserting the drawstring into the channel. The drawstring is inserted into the channel by inserting a flexible wire with a hook into the channel and pulling the drawstring through the channel. This technique is labor intensive and significantly increases production costs.

Attempts to overcome the advantages of the aforementioned process are described in U.S. Pat. No. 4,477,928 and U.S. Pat. No. Re 33,586. The patents disclose the fabrication of a woven, knitted or braided elastic band with a pull cord embedded in the band as part of the knitting, weaving or braiding process. One disadvantage of the process is that it requires the knitting or weaving machine used to manufacture the bands to be specially set up before production of the composite waistband. Setting up the knitting and weaving machines can be a time consuming process during which the machine is out of production. Once the knitting or weaving machine is properly set up to produce the composite waistband, the manufacturer will ordinarily produce a relatively large inventory of composite waistbands before switching production back to conventional elastic bands. Another disadvantage of this technique is that it requires the replacement of one or more elastomeric strands in the fabric and with the drawcord. This alters the elastic properties of the fabric band which may be undesirable.

A further attempt to produce composite elastic band/drawcords is disclosed in U.S. Pat. Nos. 5,040,244 and 5,186,779. The patents disclose the adhesion of a drawcord to one surface of a previously formed elastic band. The chosen adhesive retains the drawcord in place along with the length of the band until fabrication of the composite band into a garment, but releases the drawcord from the band thereafter to serve as a freely slidable drawcord. One disadvantage of this product is the tendency of the releasable adhesive to allow the drawcord and elastic band to become separated prematurely. Further, the manufacturer of this type of composite waistband requires the use of special manufacturing equipment to heat and cure the adhesive.

In order to overcome the above disadvantages and deficiencies, applicant has earlier invented a composite elastic band/drawcord product including an elongated band of elastic material and a drawcord disposed adjacent a surface of the elastic band and secured thereto by a stitching yarn defining a longitudinally extending channel through which the drawcord extends. This invention is further described in applicant's U.S. Pat. No. 5,375,266 to Crisco.

One method and apparatus for forming composite drawcord/elastic waistbands according to applicant's U.S. Pat. No. 5,375,266 is disclosed in U.S. Pat. No. 5,400,729 to Bryant. The method involves feeding an elastic band through a sewing machine, feeding a drawcord through the sewing machine, and connecting the drawcord to a stretched segment of the elastic band with the sewing machine by forming a plurality of longitudinally spaced stitches extending over the drawcord. Typically, this method requires that the waistband be formed on a first knitting machine with the drawcord being secured to the waistband at a second sewing machine. This process requires additional capital expense for sewing equipment. Further, care must be taken in the sewing operation to avoid penetration of the drawcord itself with the sewing thread so that the drawcord remains free to move relative to the elastic band.

A further method and apparatus for forming composite drawcord/elastic waistbands according to applicant's U.S. Pat. No. 5,375,266 is disclosed in U.S. Pat. No. 5,452,591 to King. In that patent, a process is disclosed wherein an elastic band is fabricated with an integrated drawcord utilizing a crochet-type warp knitting machine. The process includes initially knitting a finished elastic band and then rerouting the finished band back through the knitting machine to a second knitting location at which fabric piercing needles are utilized to knit additional warp and filling yarns while a drawcord is simultaneously fed between the piercing needles to form a covering web over the drawcord defining a tunnel area between the covering web and the finished band in which the drawcord is captured. One significant drawback of this process and apparatus is that the number of composite waistbands which may be formed on a given machine is limited. Because the knitting bed must include locations both for forming the elastic band and for securing the drawcord to the elastic band, the number of elastic bands which may be formed on the needle bed is reduced by half or more. Further, because the apparatus as disclosed requires that the band be looped back around behind the needle bed, monitoring of the travel of the band is compromised. Because the elastic band follows a path which at one portion has a component parallel to the needle bed, there may be a tendency for the elastic band and/or the drawcord to become mispositioned along the needle bed.

Thus, there exists a need for a method and apparatus for forming composite drawcord/elastic waistbands of the type having a drawcord secured to an elastic band by a covering web which extends over the drawcord which is convenient and cost effective to implement. Further, there exists a need for such a method and apparatus which increases the production rate of such composite drawcord/elastic waistbands. Moreover, there exists a need for a method and apparatus for forming such waistbands which may be practiced on conventionally available machinery with convenient and cost effective modifications. There exists a need for a method and apparatus as described above wherein machinery so modified may be conveniently and cost effectively converted to operate in conventional fashion.

SUMMARY OF THE INVENTION

The present invention is directed to a knitting machine for forming a composite band including an elongate knitted band and a drawcord secured to a front face of the knitted band by a covering yarn overlying the drawcord and stitched to the elongate band. The knitting machine includes a frame. A first knitting station is provided supported by the frame for forming the elongate knitted band. A second knitting station is provided supported by the frame and downstream of the first knitting station for receiving the knitted band after it exits the first knitting station. The second knitting station is operative to stitch the covering yarn to the knitted band from opposite sides of and across the drawcord to form a channel area defined between the covering yarn and the front face of the knitted band, the drawcord disposed in the channel area.

Preferably, the first knitting station includes a first reciprocating elongate needle bed along a first plane, a first warp yarn guide bar, and at least one first filling yarn guide bar. Preferably, the second knitting station includes, a second reciprocating elongate needle bed along a second plane, a second warp yarn guide bar, and at least one second filling yarn guide bar. The first and second planes are spaced apart from each other. Preferably, the respective needle beds are interconnected such that their respective reciprocating movements are synchronized with one another. The elongate needle may be interconnected by a timing belt. Preferably, the respective warp yarn guide bars interconnected such that their respective reciprocating movements are synchronized with one another. The respective warp yarn guide bars may be interconnected by a timing belt. Preferably, the first warp yarn guide bar is reciprocated side to side by a first roller arm engaging a rotating cam at a first location and the second warp yarn guide bar is reciprocated side to side by a second roller arm engaging the rotating cam at a second location.

The knitting machine may further include a take-up mechanism mounted on the frame and downstream of the second knitting station, the take-up mechanism operative to draw the composite band downwardly from the second knitting station.

Where the second knitting station includes a second elongate needle bed and a second filling yarn guide bar, a vertical support having an upper end and a lower end may be provided. The second filling yarn guide bar is mounted on the lower end and positioned proximate the second elongate needle bed, and the upper end is mounted on a head forming a part of the knitting machine for up and down movement. The upper end of the vertical support may be mounted on the knitting machine for side to side reciprocal movement. Preferably, means are provided for adjusting the distance between the second filling yarn guide bar and the second elongate needle bed. The adjusting means may include an elongate slot formed through the lower end of the vertical support and a bolt extending through the slot and to the second filling yarn guide bar. A second vertical support may be spaced from and disposed parallel to the first vertical support, the second filling yarn guide bar extending between the vertical supports.

The present invention is further directed to a method for forming a composite band including an elongate knitted band and a drawcord secured to a front face of the knitted band by a covering yarn overlying the drawcord and stitched to the elongate band. The elongate knitted band is formed at a first knitting station of a knitting machine by progressively knitting a first set of yarns on a set of knitting needles carried along an upper needle bed. The elongate knitted band is directed downstream to a second knitting station forming a part of the knitting machine. At the second knitting station, the covering yarn is stitched to the elongate knitted band from opposite sides of and across the drawcord to form a channel area defined between the covering yarn and the front face of the knitted band, the drawcord disposed in the channel area. Further, the composite band formed at the second knitting station may be drawn away from the second knitting station by means of a take-up mechanism forming a part of the knitting machine.

The preceding and further objects of the present invention will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENT

The terms "left", "right", "front", and "rear", and words of like nature are used herein only for the purposes of explaining and describing the preferred embodiments of the invention.

Figure 1:
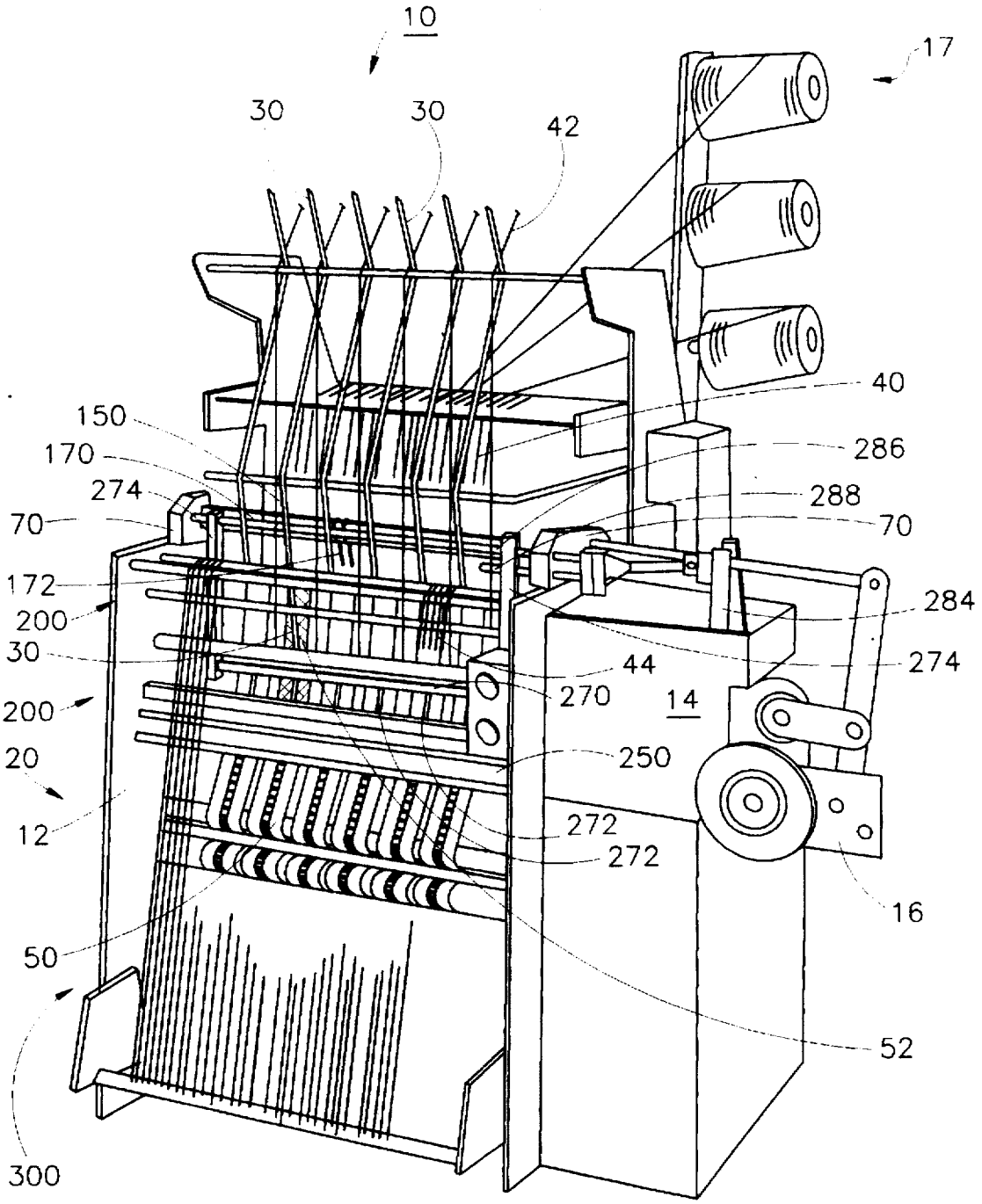
FIG. 1 is a front, perspective view of a knitting machine according to the present invention.
Figure 7:
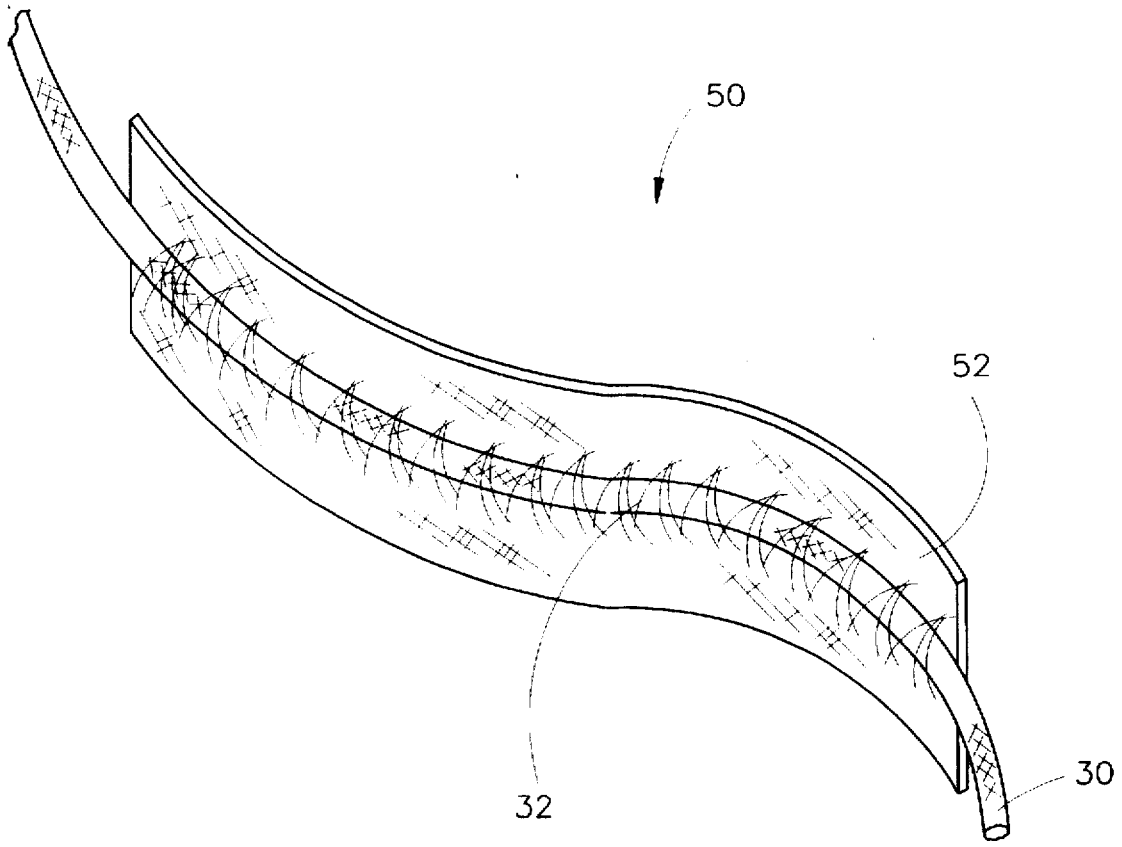
FIG. 7 is a perspective view of a section of a composite drawcord/elastic waistband as produced by the knitting machine.

With reference to FIG. 1, a knitting machine according to the present invention is shown therein and generally denoted by the numeral 10. Knitting machine 10 serves to produce composite drawcord/elastic waistbands 50 as shown in FIG. 7. Each composite drawcord/elastic waistband web 50 includes an elastic band 52 having a drawcord 30 slidably secured thereto by a covering yarn web 32. Knitting machine 10 may be a purpose built apparatus or, alternatively, a conventional flat bed, warp knitting machine modified as described below. Preferably, the knitting machine is a crochet-type knitting machine. Suitable crochet-type warp knitting machines which may be modified to form the knitting machine 10 include crochet machine model no. CX-400 manufactured by Fillattice SPA of Milano, Italy. It will be appreciated by those of ordinary skill in the art that other types of knitting machinery and methods may be used to practice the method of the present invention.

Figure 2:
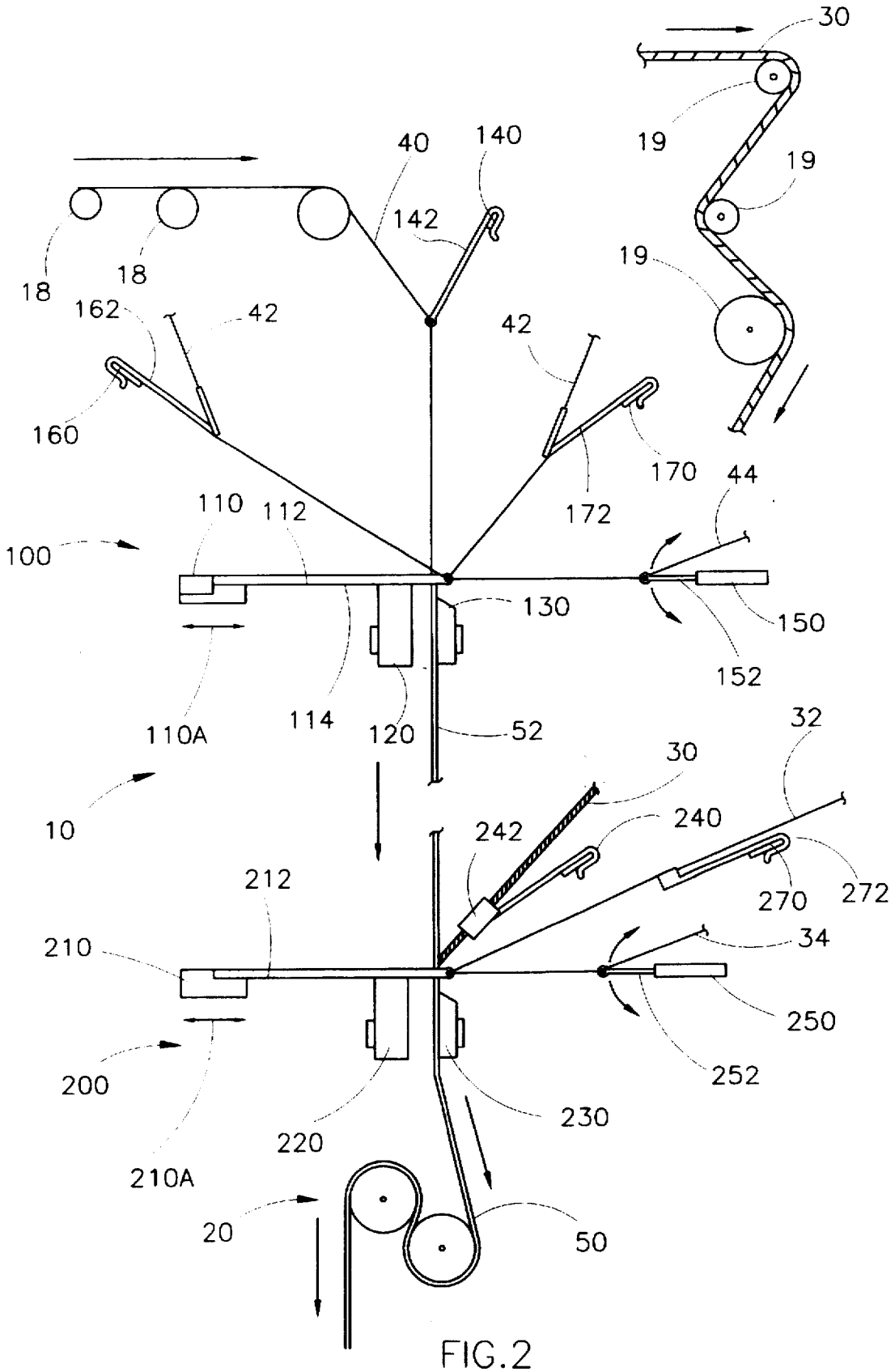
FIG. 2 is a schematic, vertical cross sectional view of the knitting machine showing an upper knitting station, a lower knitting station and a take-up mechanism.

As best seen in FIG. 2, composite drawcord/elastic bands 50 are produced on knitting machine 10 as follows. Elastic bands 52 are formed from elastic yarns 40, filler yarns 42, and warp yarns 44 by means of upper knitting station 100. Elastic bands 52 continue downwardly to lower knitting station 200 at which point cords 30 are secured thereto by means of filler yarns 32. The composite drawcord/elastic bands 50 formed thereby are drawn downwardly from lower knitting station 200 by driven take off mechanism 20. The composite band 50 may thereafter be packaged as desired. It is important that each of the many motions of various components of the upper and lower knitting stations 100, 200 be synchronized to allow smooth and accurate formation of the composite band. To this end, knitting machine 10 includes several mechanisms and components for insuring the synchronization of certain elements and components of the knitting stations. The following discussion describes the formation of a single composite band 50, however, it will be appreciated that several such bands may be formed simultaneously and in parallel, the actual number depending on the size of the knitting machine and the sizes of the knitted bands.

Knitting machine 10 includes conventional frame 12 to which are appended cam drum 14 and long throw box 16 in conventional fashion. With reference to FIGS. 1 and 2, knitting machine 10 includes upper knitting station 100 which is conventional in nature. More particularly, upper knitting station 100 includes rear needle bed 110, front needle bed 120, warp yarn guide bar 150 (hereinafter "warp bar 150"), guide plate 130, and elastic yarn guide bar 140. Rear needle bed 110 has needle bed slots 112 and needles 114 secured therein. Rear needle bed 110 reciprocates forwardly and rearwardly as indicated by direction arrow 110A, toward and away from front needle bed 120 which has slots (not shown) aligned with slots 112. Warp bar 150 is disposed forwardly of front needle bed 120 and carries a series of warp yarn guide eyelets 152 projecting rearwardly toward the front needle bed. Warp guide eyelets 152 correspond in number and spaced arrangement to needles 114 in needle bed slots 112. A selected number of warp yarns 44 are fed in side by side parallel spaced relation from a yarn creel 17 for feeding each individual warp yarn 44 to a respective needle 114.

Rear filling yarn guide bar 160 (hereinafter "rear filler bar 160") extends widthwise across frame 12 above front needle bed 120 on the rear side thereof and carries filling yarn guide sleeve elements 162. Front filling yarn guide bar 170 (hereinafter "front filler bar 170") extends widthwise across frame 12 above front needle bed 120 on the front side thereof. Front filler bar 170 carries filling yarn guide sleeve elements 172. A pair of filling yarns 42 are fed from the creel to and through respective guide sleeves 162, 172 for delivery to needles 114 simultaneously with warp yarns 44.

An elastic yarn guide bar or "rubber bar" 140 is disposed directly above and somewhat forwardly of front needle bed 120 and carries a series of elastic yarn guide eyelets 142 extending downwardly toward needle bed 120. Guide eyelets 142 correspond in number and spaced arrangement to needles 114 and warp yarn guide eyelets 152. A series of elastic yarns 40 are fed to the rear side of the knitting machine and in parallel side by side relation over a series of tensioning guide rollers 18 downwardly to eyelets 142 from which each elastic yarn 40 is fed to a respective knitting needle 114 simultaneously with warp yarns 44.

Each of the aforementioned guide bars 140, 150, 160, and 170 are supported on frame 12 of knitting machine 10 by a conventional mechanical arrangement including a patterning mechanism. The patterning mechanism controls the respective reciprocatory movements of the guide bars in timed synchronism relative to the forward-rearward reciprocations of rear needle bed 110. In this manner, the respective yarns 40, 42, and 44 are manipulated with respect to reciprocating needles 114 to effect, in conjunction with the reciprocating motion of the needles 114, a knitting action on the yarns to fabricate them progressively into an elongate knitted band 52 of a conventional crochet-type knitted fabric structure of an extended indefinite length. The mechanical arrangements for effecting the aforementioned movements will be described below to the extent that they facilitate the explanation or operation of the modifications to the conventional crochet-type knitting machine.

Figure 3:
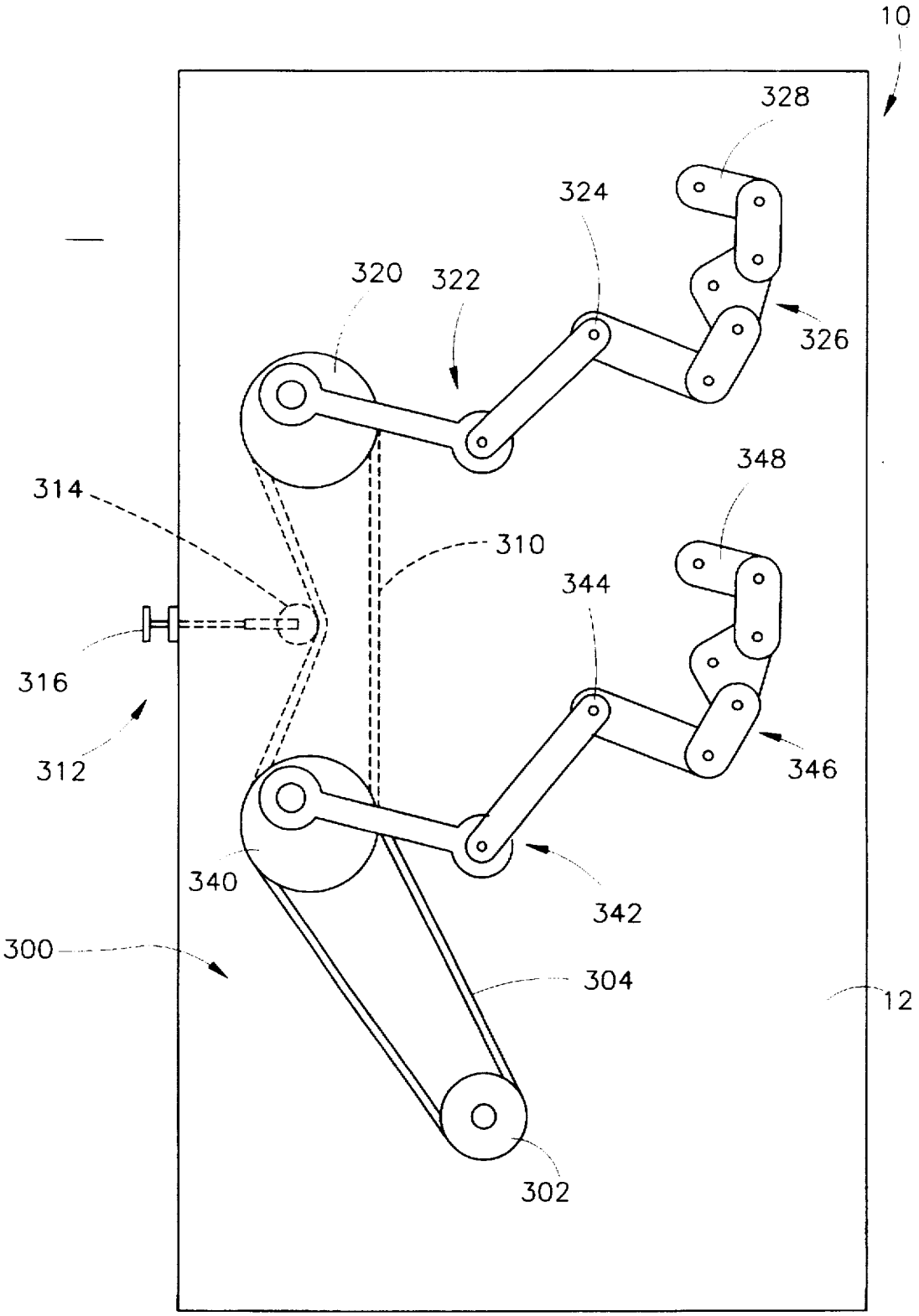
FIG. 3 is a fragmentary, side elevational view of the knitting machine showing a drive shaft, main shafts, and linkages for controlling movements of upper and lower rear needle beds and upper and lower warp yarn guide bars.

Upper rear needle bed 110 reciprocates frontwardly and rearwardly as described above. With reference to FIG. 3, this movement of upper rear needle bed 110 is accomplished by upper main shaft 320, upper first linkage 322, and needle bed connection 324. Each of these elements are conventional and their operation and configuration will be appreciated by those of ordinary skill in the art.

Figure 6:
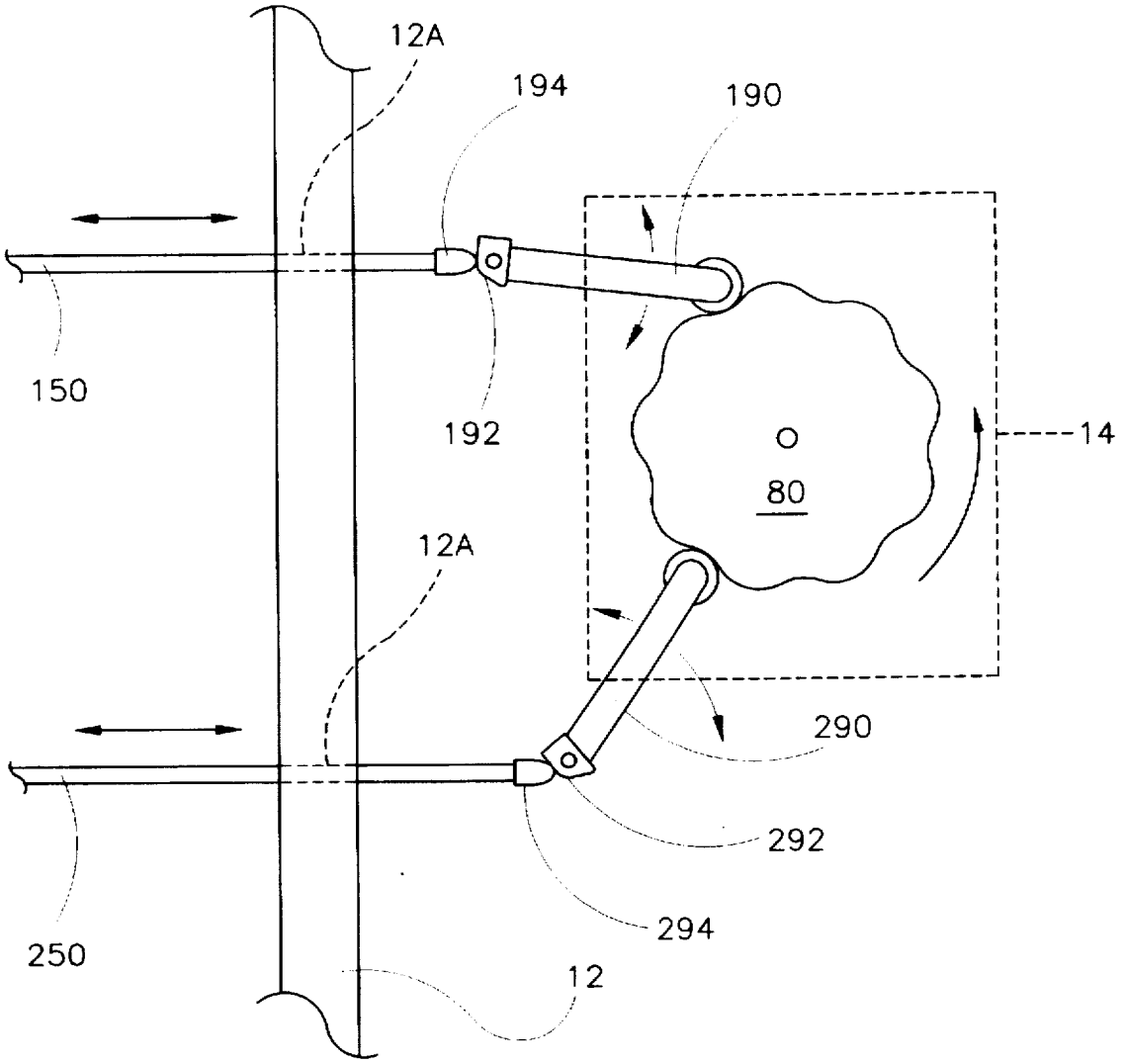
FIG. 6 is a fragmentary, schematic, cross sectional front view of the knitting machine showing mechanisms for controlling side to side movements of the upper and lower warp yarn guide bars.

Warp bar 150 reciprocates laterally from side to side relative to frame 12 of the knitting machine 10, as indicated in FIG. 6, and also pivots upwardly and downwardly, as indicated in FIG. 2. The combined motions of warp bar 150 effect a wrapping of yarns 44 about respective needles 114. The mechanisms for controlling upper warp bar 150 are conventional and their overall operation will be understood by those of ordinary skill in the art upon a reading of the following description.

With reference to FIG. 3, the up-down reciprocation of upper warp bar 150 is accomplished by the rotation of upper main shaft 320 which is connected to upper warp bar 150 by upper second linkage 326 and warp bar connection 328, each of which are conventional. Main drive shaft 302 drives lower main shaft 340 by means of transmission belt 304. Lower main shaft 340 in turn drives upper main shaft 320 by means of timing belt 310 as discussed in more detail below. Alternatively, shaft 320 may be driven by a transmission belt between shaft 320 and shaft 302, in which case shaft 340 would be driven by timing belt 310. Further, chains or gears may be provided in place of one or both of the belts.

The side to side reciprocation of upper warp bar 150 is accomplished by the rotation of cam 80 of cam drum 14. As cam 80 is rotated, upper roller arm 190 is pivoted upwardly and downwardly. The pivoting of roller arm 190 rotates abutment 192 against which warp bar head 194 is spring biased, causing warp bar 150 to be laterally displaced as roller arm 190 moves up and down. Warp bar 150 is free to slide side to side through hole 12A formed in frame 12.

Elastic yarn guide bar 140 is driven up and down by head mounts 70, as best seen in FIG. 1. Head mounts 70 are selectively driven up and down by a conventional shaft (not shown) forming a part of the knitting machine 10. Elastic yarn guide bar 140 is also moved sidewardly relative to the knitting machine by a cam in the cam box and a suitable linkage (not shown). The mechanisms and operations for reciprocating the elastic yarn guide bar 140 are conventional and will be understood by those of ordinary skill in the art.

Upper front filler bar 170 and upper rear filler bar 160 are each reciprocated up and down by head mounts 70. The filler bars are each reciprocated side to side relative to frame 12 by long throw box 16. Tic mechanisms and operations for controlling these movements of the upper front and rear filler bars are conventional and will be understood by those of ordinary skill in the art.

Generally, warp bar 150 reciprocates laterally and vertically to wrap warp yarns 44 about the respective needles 114. Filler bars 160, 170 simultaneously reciprocate side to side to cause the respective filling yarn guide elements 162, 172 to traverse back and forth laterally through a range of motion essentially corresponding to the number of needles 114 being utilized to knit the band of a given width to lay filling yarns 42 laterally across all of needles 114 during each reciprocatory cycle of rear needle bed 110. Elastic yarn guide bar 140 simultaneously reciprocates side to side to feed elastic yarns 42 to respective needles 114. As this knitting operation progresses, the resultant knitted band 52 is drawn downwardly from the forward side of front needle bed 120 between front needle bed 120 and guide plate 130 mounted at a forward spacing therefrom, by a driven take off assembly 20. Take off assembly 20 is preferably a conventional mechanism including two or more driven rollers. Take off assembly 20 is preferably lowered from its conventional position in frame 12 to allow space for lower knitting station 200 as described below.

Once knitted band 52 has been formed by upper knitting station 100 as described above, it continues downwardly as a continuous web to lower knitting station 200. Lower knitting station 200 includes rear needle bed 210 which reciprocates forwardly and rearwardly as indicated by direction arrow 210A. Rear needle bed 210 includes needle slots 212 formed therein. For each web 52, a pair of laterally spaced needles 214 are mounted in respective needle slots 212. Needles 214 are positioned such that as they pierce elastic band 52 they are disposed on opposite sides of drawcord guide element 242 which presents cord 30 to the front surface of web 52. Drawcord guide element 242 is preferably sidewardly adjustable and remains stationary in operation. Lower knitting station 200 includes front needle bed 220 and guide plate 230 corresponding to front needle bed 120 and guide plate 130 of upper knitting station 100. Lower warp yarn guide bar 250 (hereinafter "lower warp bar 250") includes a pair of warp guide eyelets 252 for each pair of needles 214, eyelets 252 corresponding in location and arrangement with needles 214. Lower front filling yarn guide bar 270 (hereinafter "lower filler bar 270") includes a filling yarn guide element 272 for each cord 30, the filling yarn guide element extending downwardly and rearwardly adjacent front needle bed 220.

A pair of warp yarns 34 are fed from the creel and through the pair of warp yarn guide eyelets 252 to respective piercing needles 214. One or more filling yarns 32 are fed from the creel through guide element 272 to the piercing needles 214. At the same time, drawcord 30 is fed through guide sleeve 242 downwardly between front needle bed 220 and guide plate 230 centrally along the forward face of knitted band 52 between piercing needles 214. Drawcord 30 is preferably tensioned and guided by a series of rollers 19. Rollers 19 also serve to hold the drawcord away from the components of upper knitting station 100.

The respective reciprocatory motions of lower rear needle bed 210, lower warp bar 250, and lower front filler bar 270 manipulate the piercing needles 214, warp yarn guide eyelets 252, and filling yarn guide elements 272 relative to one another in the same fashion as described with regard to upper knitting station 100. The several reciprocatory motions cause filling yarn(s) 32 to traverse laterally back and forth across drawcord 30 as the band penetrating and withdrawing reciprocations of piercing needles 214 knit and anchor warp yarns 34 and filling yarns 32 in the fabric of knitted band 52 along opposite sides of drawcord 30. In this maimer, warp yarns 252 and filling yarns 32 form a channel area between the forwardly facing surface of knitted band 52 and the web-like successive crossovers of filling yarn 32 in which drawcord 30 is captured.

It will be appreciated that, whereas conventional crochet-type flat bed knitting machines are typically provided with the components of upper knitting station 100, such knitting machines are not known to include components corresponding to lower knitting station 200 as well. Thus, while conventional knitting machines include the mechanisms required to control the reciprocatory movements of the components of upper knitting station 100, special provision must be made to move the several components of lower knitting station 200. In particular, means must be provided to reciprocate lower rear needle bed 210 frontwardly and rearwardly, lower warp bar 252 upwardly and downwardly and side to side, and lower front filler bar 270 upwardly and downwardly and side to side. Preferably, the movement of needle bed 210, warp bar 250, and front filler bar 270 are synchronized with the movements of the corresponding components of upper knitting station 100. Such synchronization is desirable to provide smooth, continuous, and accurate formation of the composite drawcord/elastic bands 50. Further, this ensures that the needle bed and guide bars of the lower knitting station are appropriately synchronized with respect to one another as well. However, while the use of a common drive as discussed below is the preferred approach, it will be understood that separate drive mechanisms may be used to drive each of the upper and lower knitting stations.

With reference to FIG. 3, the frontward and rearward reciprocation of lower rear needle bed 210 and the upward and downward reciprocation of lower warp bar 250 are accomplished by means of drive assembly 300. Conventional main drive shaft 302 drives lower main shaft 340. Rotation of lower main shaft 340 is translated to reciprocal movement of lower rear needle bed 210 by means of lower first linkage 342 and needle bed connection 344. Rotation of lower main shaft 340 is further translated into upward and downward reciprocation of lower warp bar 250 by lower second linkage 346 and lower warp bar connection 348. Lower main shaft 340, linkages 342, 346, and connections 344, 348 correspond to elements 320, 322, 326, 324, and 328, respectively, of upper knitting station 100. Again, these mechanisms of upper knitting station 100 are conventional and their operation will be understood by those of ordinary skill in the art. The reciprocations of lower rear needle bed 210 and lower warp bar 250 are synchronized with the movements of the corresponding structures of upper knitting station 100 by means of timing belt 310 which extends between the pulley of lower main shaft 340 and the pulley of upper main shaft 320. Preferably, a tension adjustment mechanism 312 including pulley 314 and set means 316 is provided to maintain an appropriate tension in timing belt 31 0. Set means 316 may be, for example, a screw-type mechanism including a threaded shaft mounted in an interiorly threaded collar, a ratchet-type mechanism, or any other suitable means.

With reference to FIG. 6, lower roller arm 290 is provided to effect the side to side reciprocation of lower warp bar 250. Roller arm 290 preferably rides on the same cam 80 as upper roller arm 190. The up and down pivoting of roller arm 290 as it follows the profile of cam 80 causes the rotation of abutting surface 292 against which warp bar head 294 is spring biased, and the resulting lateral displacement of lower warp bar 250. Preferably, the roller of lower roller arm 290 is positioned directly vertically below the roller of upper roller arm 190. In this manner, the side to side reciprocations of the upper and lower warp bars are synchronized.

Figure 4:
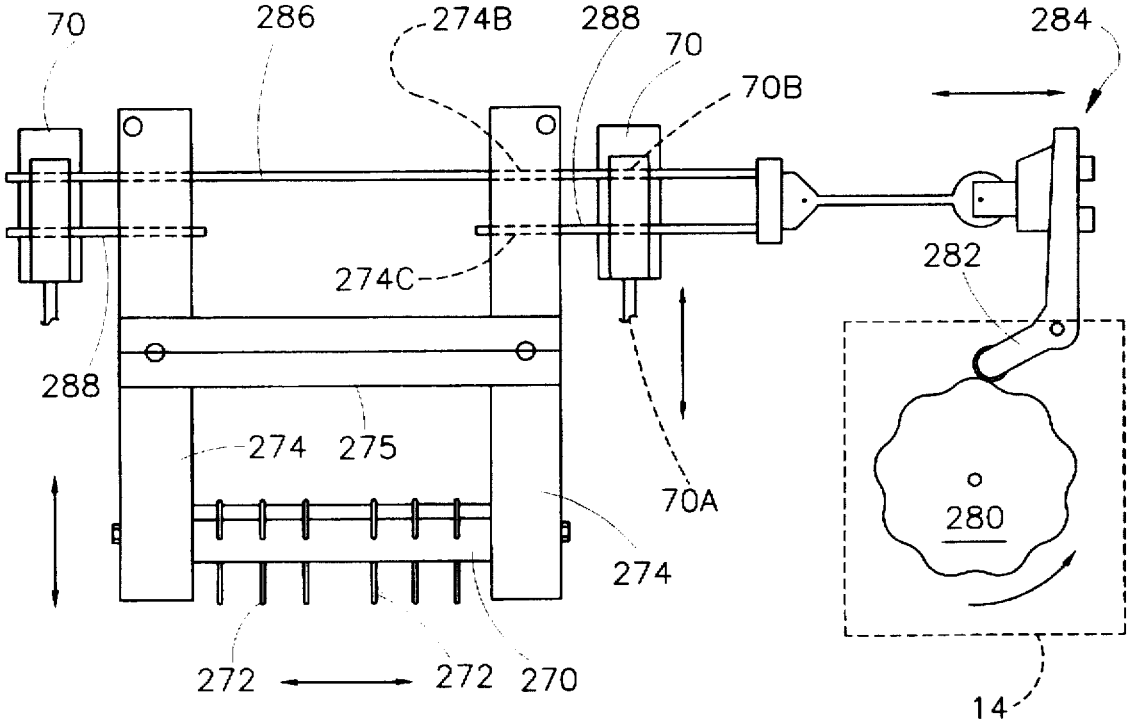
FIG. 4 is a fragmentary, front, schematic view of the knitting machine showing mechanisms for controlling up and down and side to side movements of a lower front filling yarn guide bar of the knitting machine.

With reference to FIG. 4, lower front filler bar 270 must be reciprocated upwardly and downwardly as well as side to side to form the desired covering web 32 of composite band 50. Lower front filler bar 270 is moved up and down by means of conventional head mounts 70 which are raised and lowered with respect to frame 12, and thus needle bed 210, on shafts 70A. More particularly, filler bar 270 is mounted between vertical supports 274. Vertical supports 274 include holes 274B through which cross rod 286 extends. Vertical supports 274 are also provided with holes 274C through which short rods 288 extend. Each of rods 286, 288 are rigidly secured in the respective holes 274B and 274C. It will be appreciated that as head mounts 70 are moved up and down by the main drive shaft in conventional manner, filling yarn guide elements 272 mounted on filler bar 270 which is in turn mounted on vertical supports 274, which are in turn mounted on rods 286, 288, are raised and lowered as well. The provision of two horizontal rods 286, 288 prevents torsion or rotation of vertical supports 274 frontwardly or rearwardly with respect to the knitting machine. Preferably, cross brace 275 is also provided.

Side to side movement of lower filler bar 270 is accomplished by means of cam box 14. Rods 286 and 288 are slidably mounted in bores 70B of heads 70. As cam 280 rotates, the vertical displacement of roller arm 282 which follows the profile of the cam is translated by means of linkage 284 into side to side movement of rods 286, 288. Accordingly, filler bar 270 fixedly mounted on rods 286, 288 is likewise moved side to side. Typically, bores suitable for serving the purpose of bores 70B are provided on conventional crochet-type knitting machines. Further, supplemental brackets or the like may be provided to secure rods 286, 288 to head mounts 70 for vertical displacement therewith and lateral movement with respect thereto.

Figure 5:
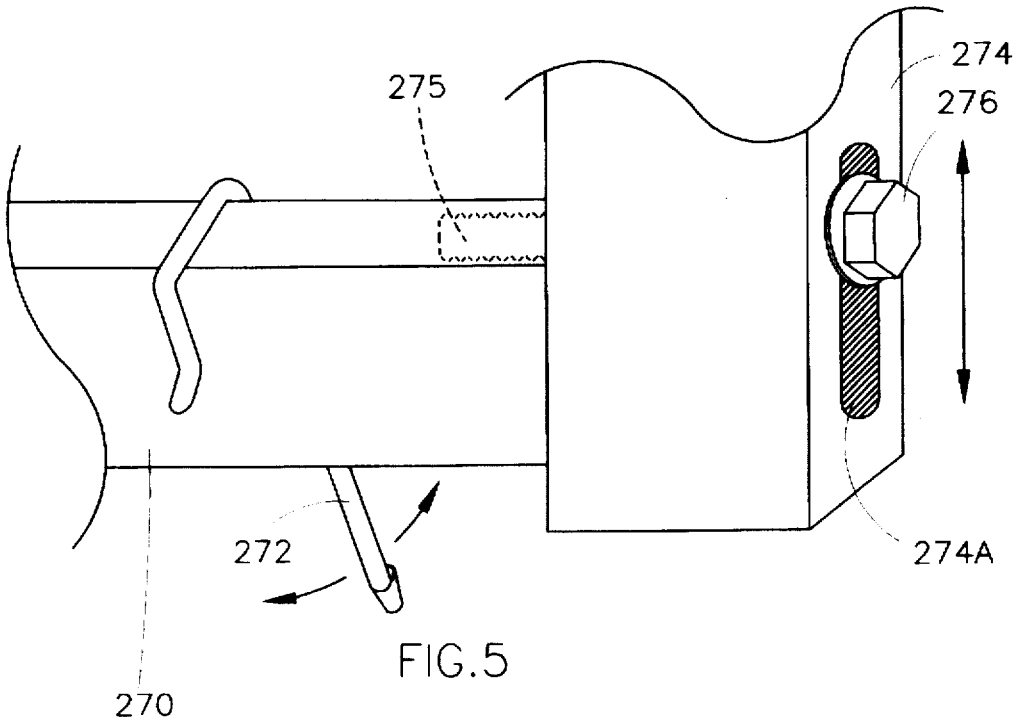
FIG. 5 is a fragmentary, perspective view showing a means for adjusting the position of the lower filling yarn guide bar.

The combination of the up and down and side to side movements of lower filler bar 270 allows the filling yarn guide elements 272 to lay the filling yarn in the needles as desired without scraping the needles with the filling yarn guide elements. With reference to FIG. 5, knitting machine 10 is preferably provided with means for adjusting the proximity of guide elements 272 to needle bed 210 as well as the angle of guide elements 272 with respect to vertical. Each vertical support 274 includes a longitudinal, vertical slot 274A formed therethrough. A bolt 276 extends through each slot 274A and screws into a threaded bore 275 formed in the adjacent end of filler bar 270. The height of filler bar 270 may be selected by loosening bolt 276 and sliding filler bar 270 upwardly or downwardly along slots 274A. Further, the angle of guide elements 272 may be adjusted by loosening bolt 276 and rotating filler bar 270 about the axis of the bolt. When the desired settings have been made, bolt 276 may be retightened, thereby locking filler bar 270 in place. Other means for selectively fixing the relative positions of the filler bar and the vertical supports may be used as well. For example, a threaded stud may be fixedly secured to the end of the filler bar and extending through the slot with a bolt on the end thereof serving to lock the bar and support in place.

After drawcord 30 has been secured to knitted band 52 by filling yarn 32, composite band 50 is drawn downwardly by take-up mechanism 20. Take-up mechanism 20 is preferably of the same design and driven in the same manner as in conventional knitting machines making such provision. If knitting machine 10 is formed by modifying a conventional knitting machine, it may be necessary to lower the take-up mechanism to allow room for lower knitting station 200.

Knitting machine 10 provides several advantages over known methods and apparatus for forming composite drawcord/elastic bands. For example, as compared with the method and apparatus described in U.S. Pat. No. 5,452,591 to King, twice as many composite bands 50 may be produced on a machine of a given width. This is because, rather than using, a single needle bed half of which is dedicated to forming the knitted band and half of which is dedicated to securing the drawcord to the band, knitting machine 10 provides a second knitting station so that the entire needle bed of the first knitting station may be used to form knitted bands. As a result, for a given amount of floor space, production may be doubled.

Notably, conventional knitting machines may be modified to practice the method of the present invention. Further, such modifications need not be permanent, rather a modified machine may be used for its original purpose by simply removing or disabling the added components, and if the take-up mechanism has been lowered, returning it to its original position.

The preceding and further objects of the present invention will be appreciated by those of ordinary skill in the art from a reading of the figures and the detailed description of the preferred embodiment which follow, such description being merely illustrative of the present invention.

What is claimed is:

1. A knitting machine for forming a composite band including an elongate knitted band and a drawcord secured to a front face of the knitted band by a covering yarn overlying the drawcord and stitched to the elongate band, said knitting machine comprising:

a) a frame;

b) a first knitting station including a first reciprocating needle bed supported by said frame for forming said elongate knitted band, said first needle bed having a length extending along a first plane; and c) a second knitting station including a second reciprocating needle bed separate and distinct from said first needle bed, said second needle bed having a length extending along a second plane spaced apart from said first plane, said second needle bed supported by said frame and spaced from and downstream of said first needle bed for receiving the knitted band after it exits said first knitting station, said second knitting station operative to stitch the covering yarn to the knitted band from opposite sides of and across the drawcord to form a channel area defined between the covering yarn and the front face of the knitted band, the drawcord disposed in said channel area.

2. The knitting machine of claim 1 wherein said first knitting station includes:

a first warp yarn guide bar; and b) at least one first filling yarn guide bar.

3. The knitting machine of claim 1 wherein said second knitting station includes:

a) a second warp yarn guide bar; and b) at least one second filling yarn guide bar.

4. The knitting machine of claim 1 further including a take-up mechanism mounted on said frame and downstream of said second knitting station, said take-up mechanism operative to draw the composite band downwardly from said second knitting station.

5. The knitting machine of claim 1 wherein said respective needle beds of said first and second knitting stations are interconnected such that their respective reciprocating movements are separately driven and synchronized with one another by mechanical synchronization means.

6. The knitting machine of claim 5 wherein said mechanical synchronization means includes a timing belt.

7. The knitting machine of claim 1 wherein each of said first and second knitting stations include a warp yarn guide bar operative to reciprocate up and down and to reciprocate side to side, said respective warp yarn guide bars spaced apart and interconnected such that their respective reciprocating movements are separately driven and synchronized with one another.

8. The knitting machine of claim 7 wherein said respective warp yarn guide bars of said first and second knitting stations are interconnected by a timing belt.

9. The knitting machine of claim 7 wherein said first warp yarn guide bar is reciprocated side to side by a first roller arm engaging a rotating cam at a first location and said second warp yarn guide bar is reciprocated side to side by a second roller arm engaging said rotating cam at a second location.

10. The knitting machine of claim 7 wherein said second knitting station includes a second filling yarn guide bar and a vertical support having an upper end and a lower end, said second filling yarn guide bar mounted on said lower end and positioned proximate said second elongate needle bed, and said upper end mounted on a head forming a part of said knitting machine for up and down movement.

11. The knitting machine of claim 10 wherein said upper end of said vertical support is mounted on said knitting machine for side to side reciprocal movement.

12. The knitting machine of claim 10 further including means for adjusting the distance between said second filling yarn guide bar and said second elongate needle bed.

13. The knitting machine of claim 12 wherein said adjusting means includes an elongate slot formed through said lower end of said vertical support and a bolt extending through said slot and to said second filling yarn guide bar.

14. The knitting machine of claim 10 including a second vertical support spaced from and disposed parallel to said first vertical support, said second filling yarn guide bar extending between said vertical supports.

15. A knitting machine for forming a composite band including an elongate knitted band and a drawcord secured to a front face of the knitted band by a covering yarn overlying the drawcord and stitched to the elongate band, said knitting machine comprising:

a) a frame;

b) a first knitting station supported by said frame for forming said elongate knitted band, said first knitting station including:

i) a first reciprocating elongate needle bed, said first needle bed having a length extending along a first plane;

ii) a first warp yarn guide bar operative to reciprocate up and down and to reciprocate side to side; and iii) at least one first filling yarn guide bar;

c) a second knitting station for receiving the knitted band after it exits said first knitting station, said second knitting station operative to stitch the covering yarn to the knitted band from opposite sides of and across the drawcord to form a channel area defined between the covering yarn and the front face of the knitted band, the drawcord disposed in said channel area, said second knitting station including:

i) a second reciprocating elongate needle bed separate and distinct from said first needle bed, said second needle bed having a length extending along a second plane spaced apart from said first plane, said second needle bed supported by said frame and spaced from and downstream of said first needle bed;

ii) a second warp yarn guide bar spaced apart from said first warp yarn guide bar operative to reciprocate up and down and to reciprocate side to side; and iii) at least one second filling yarn guide bar spaced apart from said first filling yarn guide bar;

d) a take-up mechanism mounted on said frame and downstream of said second knitting station, said take-up mechanism operative to draw the composite band away from said second knitting station;

e) said first and second needle beds interconnected such that their respective reciprocating movements are separately driven and synchronized with one another by mechanical synchronization means; and f) said first and second warp yarn guide bars spaced apart and interconnected such that their respective reciprocating movements are separately driven and synchronized with one another.

16. The knitting machine of claim 15 wherein said mechanical synchronization means includes a timing belt.

17. The knitting machine of claim 15 wherein said first and second warp yarn guide bars are interconnected by a timing belt.

18. The knitting machine of claim 15 wherein said first warp yarn guide bar is reciprocated side to side by a first roller arm engaging a rotating cam at a first location and said second warp yarn guide bar is reciprocated side to side by a second roller arm engaging said rotating cam at a second location.

19. The knitting machine of claim 15 wherein said second knitting station includes a vertical support having an upper end and a lower end, said second filling yarn guide bar mounted on said lower end and positioned proximate said second elongate needle bed, and said upper end mounted on a head forming a part of said knitting machine for up and down movement.

20. The knitting machine of claim 19 wherein said upper end of said vertical support is mounted on said knitting machine for side to side reciprocal movement.

21. The knitting machine of claim 19 further including means for adjusting the distance between said second filling yarn guide bar and said second elongate needle bed.

22. The knitting machine of claim 21 wherein said adjusting means includes an elongate slot formed through said lower end of said vertical support and a bolt extending through said slot and to said second filling yarn guide bar.

23. The knitting machine of claim 19 including a second vertical support spaced from and disposed parallel to said first vertical support, said second filling yarn guide bar extending between said vertical supports.

24. A method for forming a composite band including an elongate knitted band and a drawcord secured to a front face of the knitted band by a covering yarn overlying the drawcord and stitched to the elongate band, comprising the steps of:

a) forming the elongate knitted band at a first knitting station of a knitting machine by progressively knitting a first set of yarns on a first set of knitting needles carried along a first needle bed;

b) providing the first needle bed with a length extending along a first plane;

c) directing the elongate knitted band downstream to a second set of knitting needles carried along a second needle bed of a second knitting station forming a part of said knitting machine, the second needle bed;

d) spaced apart, separate and distinct from the first needle bed, the second providing the second needle bed with a length extending along a second plane spaced apart from the first plane; and e) at the second knitting station, stitching the covering yarn to the elongate knitted band from opposite sides of and across the drawcord to form a channel area defined between the covering yarn and the front face of the knitted band, the drawcord disposed in the channel area.

25. The method of claim 24 further including the step of drawing the composite band formed at the second knitting station away from the second knitting station by means of a take-up mechanism forming a part of the knitting machine.

* * * * *

UNITED STATES PATENT AND TRADEMARK OFFICE

CERTIFICATE OF CORRECTION

PATENT NO. : 5,758,519
DATED : June 2, 1998
INVENTOR(S) : Joyce, et al.

It is certified that error appears in the above-identified patent and that said Letters Patent is hereby corrected as shown below:

Claim 24(c) and (d) should read as follows:

c) directing the elongate knitted band downstream to a second set of knitting needles carried along a second needle bed of a second knitting station forming a part of said knitting machine, the second needle bed spaced apart, separate and distinct from the first needle bed;

d) providing the second needle bed with a length extending along a second plane spaced apart from the first plane; and Signed and Sealed this Eighth Day of December, 1998

Bruce Lehman

*Attest:*

BRUCE LEHMAN

*Attesting Officer*

*Commissioner of Patents and Trademarks*